US008336112B2

(12) United States Patent
Weber et al.

(10) Patent No.: US 8,336,112 B2
(45) Date of Patent: Dec. 25, 2012

(54) BODY ARMOR WITH OVERLAPPING LAYERS OF BALLISTIC MATERIAL

(75) Inventors: Bob Weber, Mojave Valley, AZ (US); David Miller, Phelan, CA (US)

(73) Assignee: Safariland, LLC, Jacksonville, FL (US)

( * ) Notice: Subject to any disclaimer, the term of this patent is extended or adjusted under 35 U.S.C. 154(b) by 161 days.

(21) Appl. No.: 12/696,370

(22) Filed: Jan. 29, 2010

(65) Prior Publication Data

US 2011/0185464 A1 Aug. 4, 2011

(51) Int. Cl.
*F41H 1/02* (2006.01)
*F41H 1/00* (2006.01)

(52) U.S. Cl. ..... 2/2.5; 428/911; 89/36.05

(58) Field of Classification Search ..... 2/2.5; 428/911
See application file for complete search history.

(56) References Cited

U.S. PATENT DOCUMENTS

| | | | | | |
|---|---|---|---|---|---|
| 4,183,097 | A | | 1/1980 | Mellian | |
| 4,241,457 | A | * | 12/1980 | Klein et al. | 2/2.5 |
| 4,316,286 | A | | 2/1982 | Klein | |
| 4,443,506 | A | | 4/1984 | Schmolmann | |
| 4,697,285 | A | * | 10/1987 | Sylvester | 2/2.5 |
| 5,020,157 | A | | 6/1991 | Dyer | |
| 5,185,195 | A | * | 2/1993 | Harpell et al. | 428/102 |
| 5,196,252 | A | * | 3/1993 | Harpell | 428/102 |
| 5,198,280 | A | * | 3/1993 | Harpell et al. | 428/102 |
| 5,316,820 | A | * | 5/1994 | Harpell et al. | 428/109 |
| 5,362,527 | A | * | 11/1994 | Harpell et al. | 428/33 |
| 5,466,503 | A | | 11/1995 | Dischler | |
| 5,619,748 | A | * | 4/1997 | Nelson et al. | 2/2.5 |
| 5,660,913 | A | | 8/1997 | Coppage, Jr. | |
| 5,677,029 | A | * | 10/1997 | Prevorsek et al. | 428/113 |
| 5,724,670 | A | | 3/1998 | Price | |
| 5,918,309 | A | | 7/1999 | Bachner, Jr. | |
| 5,926,842 | A | * | 7/1999 | Price et al. | 2/2.5 |
| 5,943,694 | A | | 8/1999 | Moureaux et al. | |
| 5,960,470 | A | * | 10/1999 | Bachner, Jr. | 2/2.5 |
| 6,026,509 | A | * | 2/2000 | Bachner, Jr. | 2/2.5 |
| 6,047,399 | A | * | 4/2000 | Bachner, Jr. | 2/2.5 |
| 6,119,575 | A | | 9/2000 | Dragone et al. | |
| 6,131,193 | A | * | 10/2000 | Bachner, Jr. | 2/2.5 |
| 6,151,710 | A | * | 11/2000 | Bachner, Jr. | 2/2.5 |
| 6,154,880 | A | * | 12/2000 | Bachner, Jr. | 2/2.5 |
| 6,195,798 | B1 | * | 3/2001 | Bachner, Jr. | 2/2.5 |
| 6,219,842 | B1 | * | 4/2001 | Bachner, Jr. | 2/2.5 |
| 6,240,557 | B1 | * | 6/2001 | Bachner, Jr. | 2/2.5 |
| 6,266,819 | B1 | * | 7/2001 | Bachner, Jr. | 2/2.5 |
| 6,449,769 | B1 | * | 9/2002 | Bachner, Jr. | 2/2.5 |
| 6,961,957 | B2 | | 11/2005 | Carlson | |
| 2009/0255022 | A1 | | 10/2009 | Smith | |
| 2009/0271903 | A1 | * | 11/2009 | Chiou | 2/2.5 |

FOREIGN PATENT DOCUMENTS

EP 1 067 355 1/2001

OTHER PUBLICATIONS

PCT International Application No. PCT/US10/22514, International Search Report and Written Opinion dated Oct. 13, 2010.

(Continued)

*Primary Examiner* — Bobby Muromoto, Jr.
(74) *Attorney, Agent, or Firm* — Kane Kessler, P.C.; Paul E. Szabo

(57) ABSTRACT

A soft body armor panel includes a subpack that is formed by overlapping sections of ballistic material and sewing them at one or more seams to form discontinuous layers in the subpack.

16 Claims, 7 Drawing Sheets

OTHER PUBLICATIONS
PCT International Application No. PCT/US10/22509, International Search Report and Written Opinion dated Oct. 6, 2010.
U.S. Appl. No. 12/391,187, Feb. 23, 2009, Weber et al.
PCT International Application No. PCT/US09/35087, International Search Report and Written Opinion dated Oct. 15, 2009.

* cited by examiner

BODY ARMOR WITH OVERLAPPING LAYERS OF BALLISTIC MATERIAL

RELATED APPLICATIONS

None

BACKGROUND OF THE INVENTION

1. Technical Field

This invention relates to body armor. In particular, this invention relates to soft body armor of the type that is commonly configured as a vest to be worn by a peace officer or soldier. The vest may include a front ballistic panel and a back ballistic panel as part of a carrier/garment for supporting the individual panels.

2. Description of the Art

U.S. Pat. No. 6,961,957 to Carlson discloses the use of a semi-rigid plastic frame incorporated with layers of flexible ballistic material. The frame helps to support the ballistic material and resist bunching and twisting of the ballistic material, thus limiting backface deformation and blunt trauma, reducing impact movement, and aiding in rapid impact recovery.

U.S. Pat. No. 4,183,097 to Mellian discloses sewing together the edges of three plies of ballistic material to form a first unit portion of a layer of a vest panel; sewing together the edges of three other plies of ballistic material to form a second unit portion of a layer of a vest panel; and thereafter stitching together the first and second unit portions to form the vest panel, which has a seam where the layers are joined. This method is used to produce a contoured (three-dimensional) panel that can conform to the curvature of the female body in the bust area.

DETAILED DESCRIPTION

This invention relates to body armor and, in particular, to soft body armor panels for use in a garment that can be worn by, for example, a peace officer. The invention is applicable to body armor of varying and different configurations. Some embodiments of the invention are illustrated in the attached drawings. The invention is not limited to these embodiments.

Figure 1:
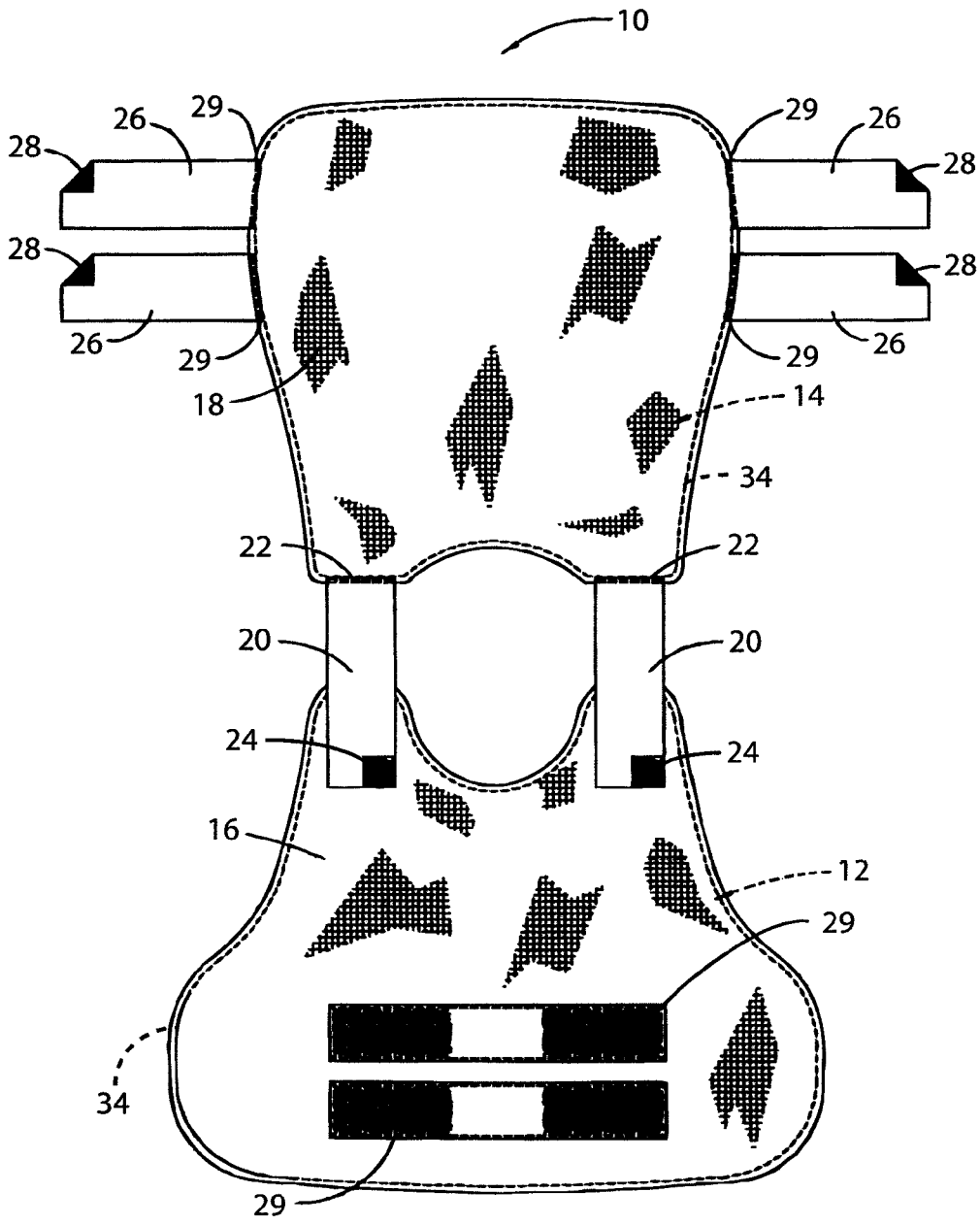
FIG. 1 is an illustration of a vest including one or more ballistic panels made in accordance with the invention.
Figure 2:
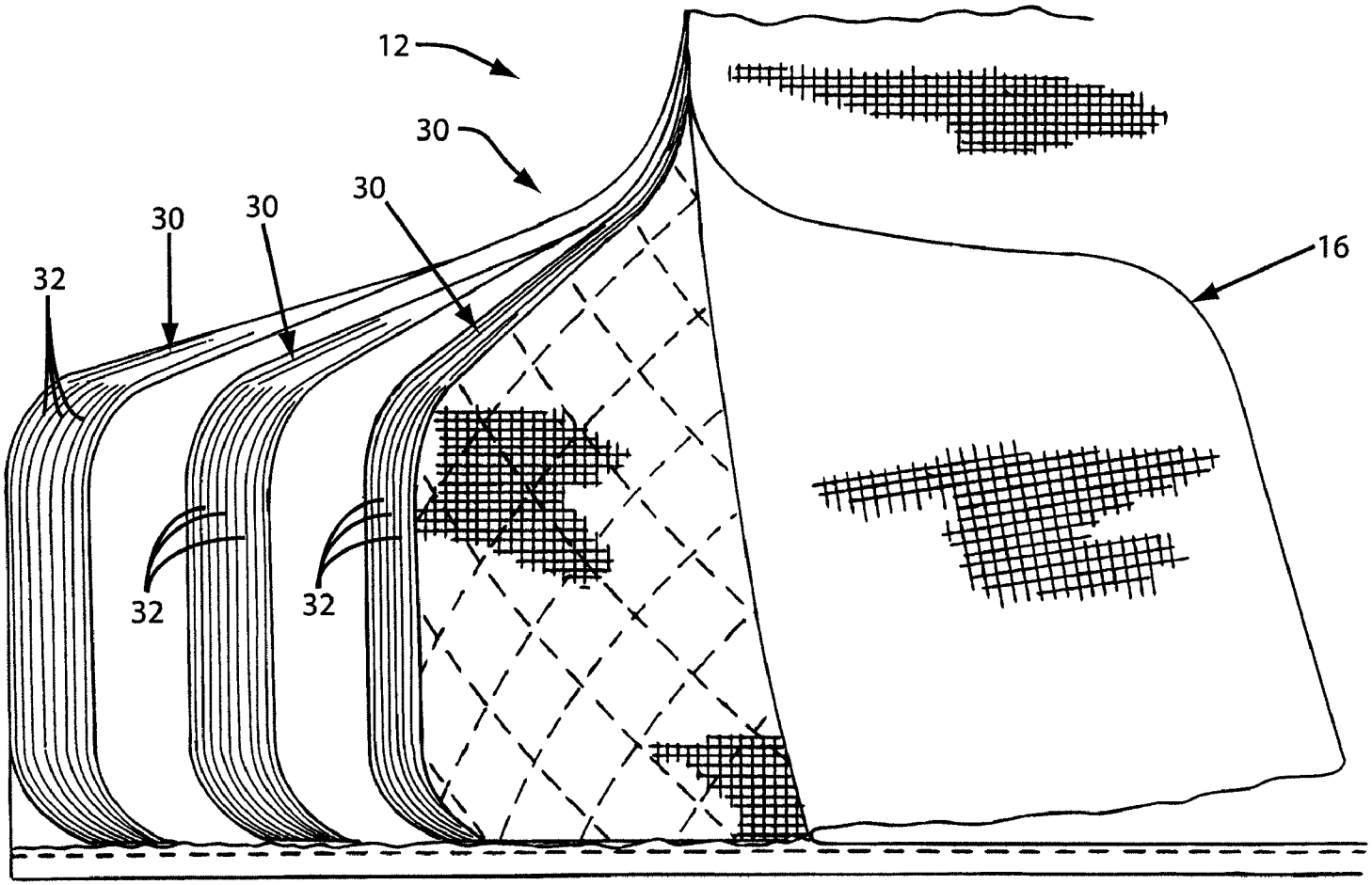
FIG. 2 is an illustration showing how a ballistic panel includes a number of subpacks each of which includes a number of layers of ballistic material.

FIG. 1 is an illustration of a typical protective garment in the form of a vest 10 including front and back ballistic panels 12 and 14, respectively, which are configured to be worn over the front and back portions of a wearer's torso. The panels 12 and 14, themselves, are enclosed in ballistic material carriers 16 and 18, respectively. The carriers 16 and 18 are joined to each other by shoulder straps 20 having one end 22 stitched to the carrier 18 of the back panel 14. The other ends of the shoulder straps 20 are adjustably connected by hook and loop fasteners 24 to the carrier 16 of the front panel 12. In use, the panels 12 and 14 are secured together at the sides of the torso by side straps 26 having adjustable hook and loop fasteners 28 at one end and having opposite ends 29 secured by stitching or other suitable means to the carrier 18 of the back panel 14.

Each one of the panels 12 and 14 includes a number of subpacks (designated "30" herein when not referring to a particular panel configuration) as shown in FIGS. 2-9. A panel is made from a plurality of subpacks rather than one "pack", to provide improved performance and flexibility while minimizing weight. A subpack is a plurality of layers (designated "32" herein when not referring to a particular layer configuration) of ballistic material, joined together as one unit, which unit is then joined with one or more additional subpacks to form a ballistic panel. This construction is shown schematically in FIG. 2 in which a number of subpacks 30 are joined together to form the panel 12. (The panel 12 described herein is exemplary; the back panel 14 may be similar.)

The panel 12, which is flat and flexible, has an outline defined by an outer periphery (perimeter) 34 (FIG. 1) that is of a particular shape and which encloses the surface area of the panel. Each one of the plurality of subpacks 30 preferably has substantially the same outline as the overall panel 12. Each one of the plurality of subpacks 30 includes a plurality of layers 32 of ballistic material, each preferably having substantially the same outline as the overall subpack. As a result, all the layers 32 of all the subpacks 30 when placed atop each other form the panel 12 which has the outline defined by the outer periphery 34.

As discussed above, each subpack 30 is made of one or more layers 32. Each layer 32 is typically one sheet (one thickness) of ballistic material. If a subpack 30 includes more than one layer 32, as is most common, then the layers are joined together to form the subpack, as described below, thus forming a unit that can be moved as one without the individual layers separating from each other.

In at least one subpack 30 of the panel 12, an "overlapping" technique, described below, is used to form the layers 32 of the subpack and to form the subpack as a whole. A layer 32 that is formed with this technique is not a continuous piece of ballistic material that covers or forms the entire outline of the layer. Rather, a layer 32 that is formed with this technique is made up of two or more layer "sections", each having a surface area less than that of the entire outline, that are sewn (stitched) together at a seam to provide the entire outline. In this regard, the layer is discontinuous at the seam.

Figure 3:
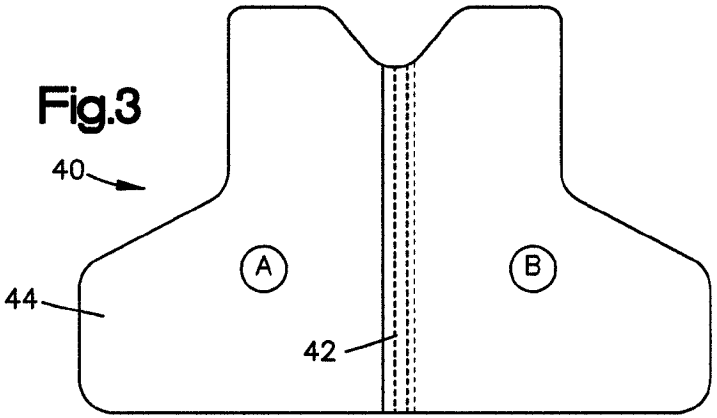
FIG. 3 is a schematic illustration of an I-Cut subpack, showing how the various layer sections are joined to form the subpack.

Typically, two to four layer sections are used to make up such a layer. For example, FIG. 3 is a schematic illustration of an "I-Cut" subpack 40, showing how various layer sections are joined to form the subpack. In this case, two layer sections, an A section and a B section, are overlapped and stitched together at a seam 42 to form a discontinuous layer 44.

The various layers that make up a subpack are not sewn individually. Rather, all of the sections that are joined at one seam are assembled unsewn, and thereafter sewn together at once, as described below, to form that portion of the subpack. There are two basic ways, discussed below, in which this overlapping technique is used—a method described herein as the "slab" method, and a method described herein as the "interlaced" method.

Figure 7:
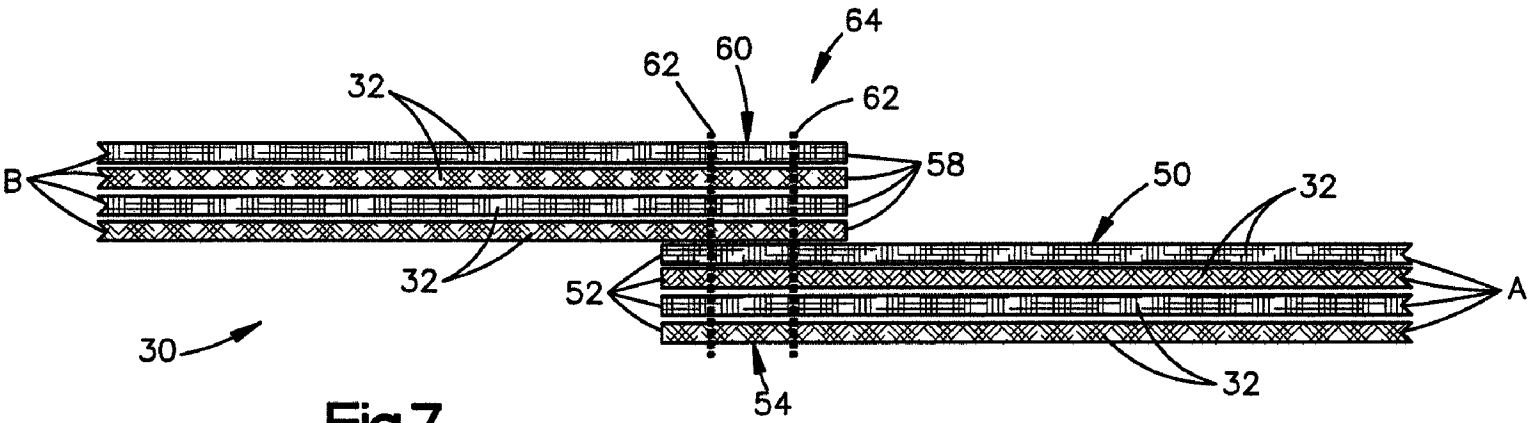
FIG. 7 is a schematic illustration of a step in the formation of a subpack using a "slab" technique.

In the "slab" method, as shown schematically in FIG. 7, all the A sections of the layers 32 of a subpack 30 are piled up together, forming a stack or slab 50. The individual edge portions 52 of the A sections, as a group, constitute an edge portion 54 of the A slab 50. Also, all the B sections of the layers 32 of the subpack 30 are piled up together, forming a stack or slab 56. The individual edge portions 58 of the B sections, as a group, constitute an edge portion 60 of the B slab 56.

Next, the B slab 56 is placed atop the A slab 50 (or vice versa), so that the edge portion 60 of the B slab overlaps the edge portion 54 of the A slab. The two slabs 50 and 56, and their component layer sections A and B, as thus assembled, have an outline that is substantially the same as (forms) the outline of the subpack 30.

The two slabs 50 and 56, and their component layer sections A and B, are then sewn together into one unit, with one or more stitching sections (sew lines) shown schematically at 62 extending through the edge portion 54 of the A slab and through the edge portion 58 of the B slab. This step forms a seam 64 where the overlapped layer sections A and B are joined. There are no continuous layers of ballistic material across the seam 64. Each layer of ballistic material is discontinuous across the seam 64.

This sewing step forms the subpack 30, if there are only two sections to the subpack. If there are more than two sections to the subpack, then the various slabs (stacks) are sewn together one pair (one seam) at a time—A sections with B sections; then C sections are added to that; then D sections are added, etc.

Build sheets for a particular vest provide specifics of how the overlapping and stitching are done. These sheets specify for each vest the minimum and maximum overlap of the edge portions of the sections to form the seam, number of stitching sections used, etc., in the one or more subpacks of that vest's panels that are formed using this overlapping technique. Examples are described below with reference to FIGS. 4-6 and 9A-9D.

The seams that are produced as a result of the overlap technique are typically not oriented along the perimeter of the subpack, but rather typically extend across (along) the width or height of the subpack. The seams are thus typically oriented either vertically or horizontally on the subpack when it is being worn (see FIGS. 3-6 as examples; specific desired locations are discussed below). As a result, the seams typically are, at their ends where they are closest to the perimeter, oriented perpendicular to the perimeter of the subpack.

The subpack may have perimeter stitching as is common, and that perimeter stitching may extend across the ends of the seams, but any such perimeter stitching is not the primary stitching that forms the seams in the subpack. Each seam is typically formed by one to three parallel sew lines that extend along the length of the seam. Aside from any tacking or perimeter stitching, the stitching section that joins the first layer sections (A sections) to the second layer sections (B sections) is typically the only stitching section that joins the first layer sections to each other, and is typically the only stitching section that joins the second layer sections to each other. That is, the procedure does not typically involve sewing the A sections together first, then sewing the B sections together, then joining the A sections to the B sections, although that is not precluded.

Figure 5:
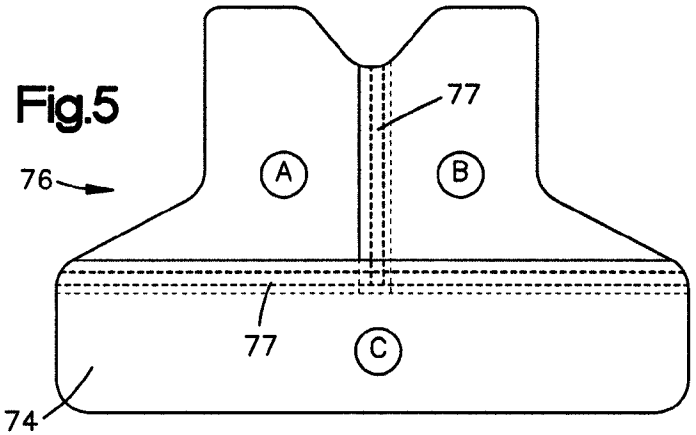
FIG. 5 is a schematic illustration of a T-Cut subpack, showing how the various layer sections are joined to form the subpack.
Figure 6:
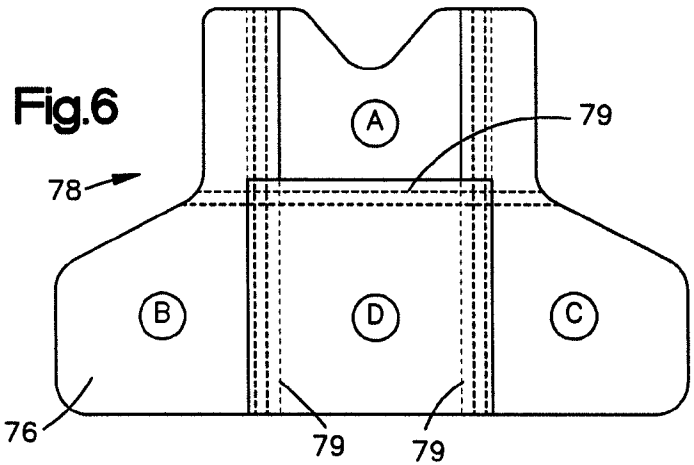
FIG. 6 is a schematic illustration of an H-Cut subpack, showing how the various layer sections are joined to form the subpack.
Figure 4:
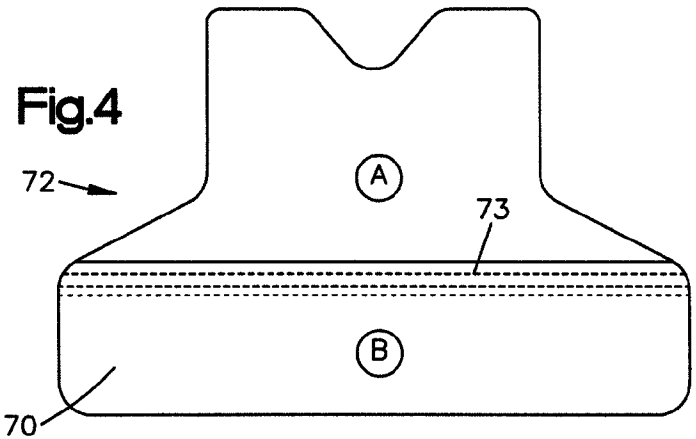
FIG. 4 is a schematic illustration of an L-Cut subpack, showing how the various layer sections are joined to form the subpack.

FIGS. 4-6 illustrate other, alternative subpack constructions, using different shapes and numbers of layer sections. FIG. 4 represents the formation of a layer 70 of an "L-Cut" subpack 72. An L-cut subpack 72 includes two layer sections in each layer 70. As shown schematically in FIG. 4, each layer 70 includes one A section and one B section that are overlapped and stitched together to form the layer, having a seam different from that of the I-cut.

FIG. 5 represents the formation of a layer 74 of a "T-Cut" subpack 76. A T-cut subpack 76 includes three layer sections in each layer 74. As shown schematically in FIG. 5, each layer 74 includes one A section and one B section and one C section that are overlapped and stitched together to form the layer.

FIG. 6 represents the formation of a layer 76 of an "H-Cut" subpack 78. An H-cut subpack 78 includes four layer sections in each layer 76. As shown schematically in FIG. 6, each layer 76 includes one A section and one B section and one C section and one D section that are overlapped and stitched together to form a layer.

Figure 8:
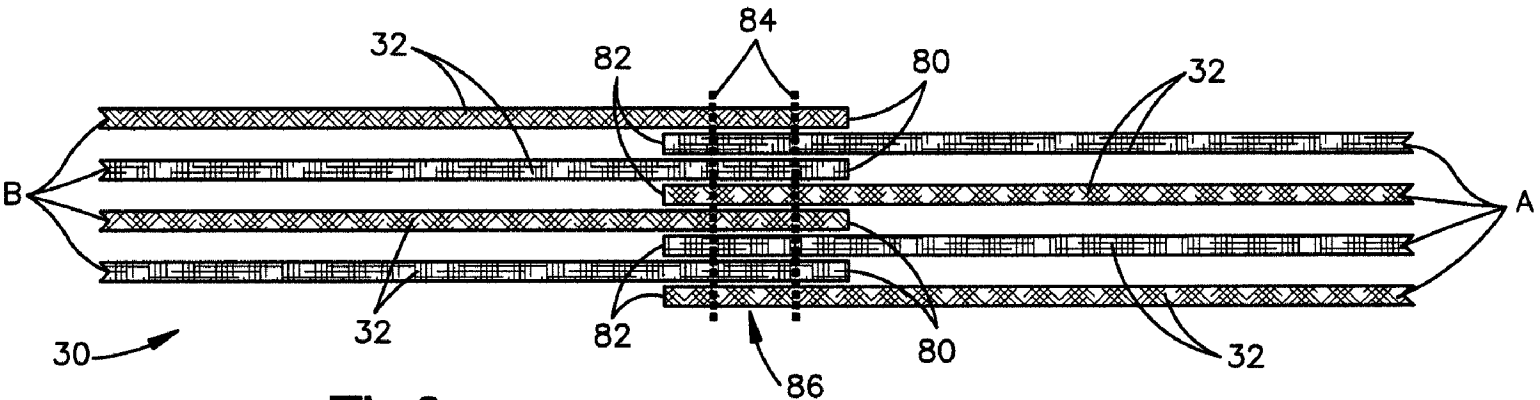
FIG. 8 is a schematic illustration of a step in the formation of a subpack using an "interlaced" technique.

An alternative to the slab method of construction described above is the "interlaced" method, which is illustrated schematically in FIG. 8 with reference to an exemplary subpack 30 having layers 32. In the interlaced method (to use a two-section construct as an example), the first step is that an A section of one layer 32 is laid down. Then, a B section of one layer 32 is laid down, with its edge portion 80 overlapping the edge portion 82 of the A section. The two sections A and B as thus associated have the outline of the subpack 30, which is substantially the outline of the panel.

Then, a second A section is laid down over the first A section, with the edge portion 82 of the second A section overlapping the edge portion 80 of the first B section and also overlying the (farther underneath) edge portion of the first A section. Then a second B section is laid down over the first B section, overlapping the second A section.

This "interlacing" technique (A-B-A-B) continues until all the needed layer sections A and B are present to form all the needed layers 32 of the subpack 30 being assembled. The assembled layer sections A and B are then sewn together as one unit, with one or more stitching sections 84 extending through all the edge portions 80 and 82 of all the layer sections A and B, thereby forming, via a seam 86, the subpack 30. Using this interlaced method, there are no continuous layers of ballistic material across the seam 86; each layer of ballistic material is discontinuous across the seam. A possible variation of the interlacing technique involves placing two or three A sections, then two or three B sections, etc.—somewhat closer to the slab variation.

A vest/subpack constructed with the overlapping layers technique has numerous benefits, a primary one being enhanced multi-hit capability. Specifically, the various sections of the subpack (and the various sections of each layer) act as isolation zones to limit the effects of multiple impacts across a panel. Because the various sections of the subpack (and the various sections of each layer) are effectively separate areas of ballistic material, an impact on one section does not produce the normal pulling force on any other section. For example, if a projectile strikes an A section of a layer, the force on the layer is not transmitted directly to the B section of that layer, because the layer is discontinuous at the location of the seam. The A section and the B section are not the same piece of ballistic material (fabric). If a projectile strikes an A section of a subpack, the force on the A section of the subpack is not transmitted directly to the B section of the subpack, because the ballistic fabric of that subpack is discontinuous at the location of the seam.

As a result, the B section will remain substantially unaffected by the sudden force applied to the A section, and the B section will be performance-ready for receiving a subsequent (second or later) impact from a second bullet, for example. If this isolation or discontinuity were not present, the A section would pull on the B section, deforming it and reorienting its fibers, thus inherently degrading the performance characteristics of the B section. The sectioned and isolated configuration that results from making the layers with the overlapping technique avoids or minimizes this degradation. The more sections that are provided for one layer/subpack, the more isolation is provided. This benefit is present with both variations of the overlapping technique—the slab variation and the interlaced variation.

Blunt trauma reduction is provided also. When there is an impact directly on the seam, the extra layers of ballistic material provide substantially increased resistance to trauma (backface deformation). Also, the ballistic material that is present at the seam provides a very high level of direct impact resistance, as compared to, for example, a plastic strip. In these cases, more stitching/seams may provide more performance; thus, an H-Cut subpack can provide more benefit in this regard than, for example, an I-Cut subpack. Twisting and bunching is also reduced to some extent by the presence of the seam.

In selecting the way the various sections are configured, the vest manufacturer can utilize this benefit, to an increased extent, by locating the seams to provide trauma reduction where it may be considered to be most needed. For example, the I-Cut configuration, with its single vertically extending seam, may have that seam be laterally centered, to provide substantially increased trauma protection at the critical locations of the sternum and spine. The L-Cut configuration, with its single horizontally extending seam that is placed at the location of the lower rib cage, provides substantially increased trauma protection at that vulnerable area. The T-Cut configuration embodies both of these features. The H-Cut configuration provides two vertically extending seams spaced apart laterally on either side of the sternum or spine, as well as a horizontally extending seam at the location of the lower rib cage, to provide substantially increased trauma protection in all these locations.

The use of the overlapping technique also helps to minimize impact movement. Impact movement occurs when an impact on, for example, a left side of a vest results in pulling fabric toward that location, away from the right side of the vest, and potentially leaving the wearer's right side more exposed. This undesirable effect is minimized by the discontinuity in fabric layers that is provided with the overlapping technique.

Impact recovery is also enhanced. The seam in an "overlapped" subpack acts to some extent as a resilient stiffening or reinforcing member in the subpack and panel, and thus helps the panel to pull itself back into shape after the first impact, thus better preparing the vest for a second impact. Of course, a stiffer vest is less comfortable to wear, and so it is desirable to provide all these benefits without excessively stiffening the vest/subpack. The techniques discussed herein have that effect.

A typical amount of overlap between sections (or slabs) is nominally 3", with +1" and −¼" tolerance. A typical seam in a subpack constructed in accordance with the overlap technique covers from about 5% to about 25% of the surface area of the subpack. The range of coverage can be up to about 50% or more for all seams in total.

Figures 9A, 9B:
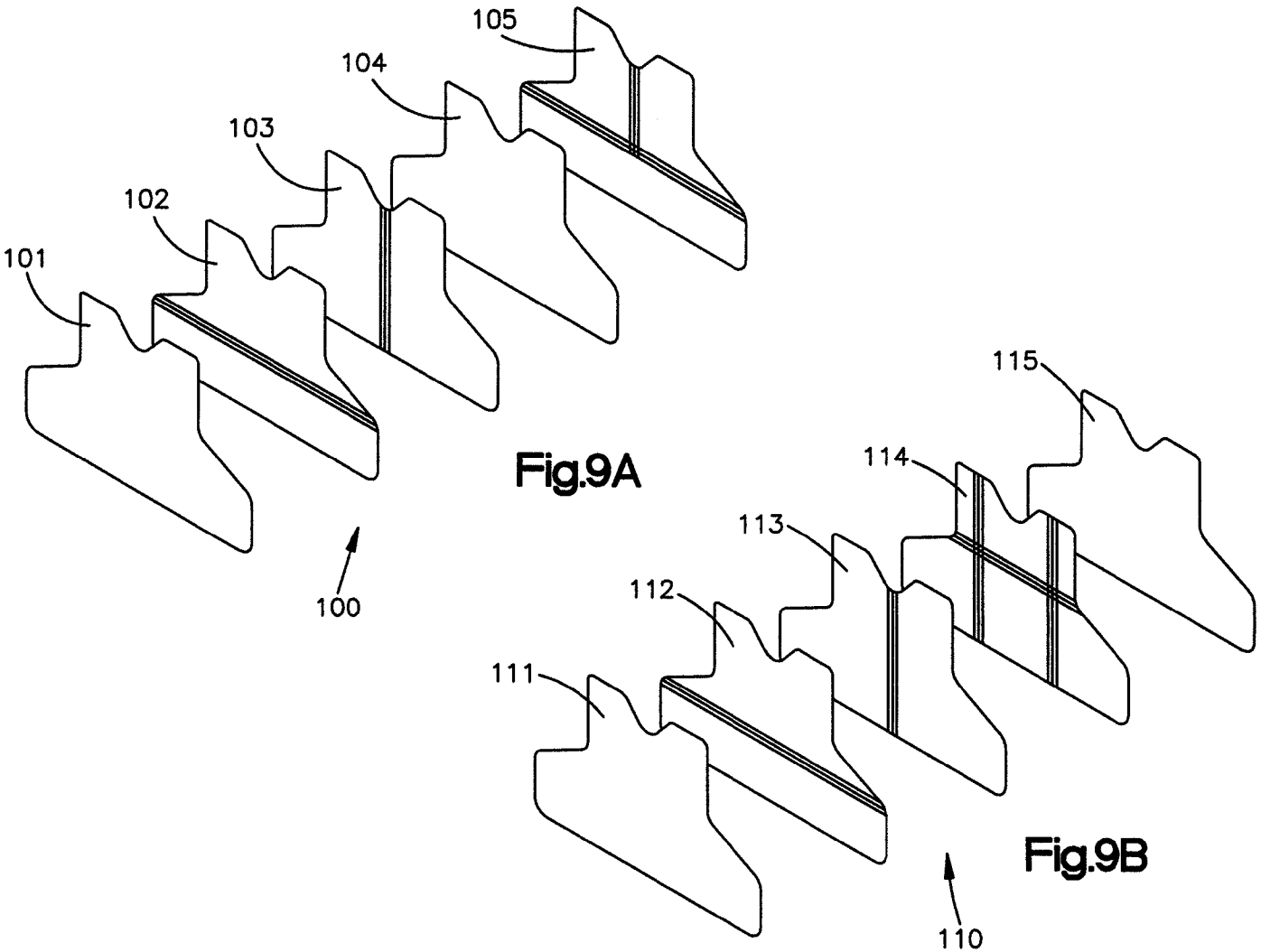
FIGS. 9A-9D are a series of views illustrating different configurations for ballistic panels that include subpacks made in accordance with the invention.

FIG. 9A illustrates portions of a build diagram for building one exemplary vest panel 100 in accordance with the present invention. The vest panel includes five subpacks 101-105. The strike face subpack 101 does not have any overlapping seams. The next inner subpack 102 is formed using an L-Cut overlapping technique. The next inner (middle) subpack 103 is formed using an I-Cut overlapping technique. The next inner subpack 104 does not have any overlapping seams. The body side subpack 105 is formed using a T-Cut overlapping technique.

FIG. 9B illustrates portions of a build diagram for building another exemplary vest panel 110 in accordance with the present invention. The vest panel 110 includes five subpacks 111-115. The strike face subpack 111 does not have any overlapping seams. The next inner subpack 112 is formed using an L-Cut overlapping technique. The next inner (middle) subpack 113 is formed using an I-Cut overlapping technique. The next inner subpack 114 is formed using an H-Cut overlapping technique. The body side subpack 115 does not have any overlapping seams.

Figures 9C, 9D:
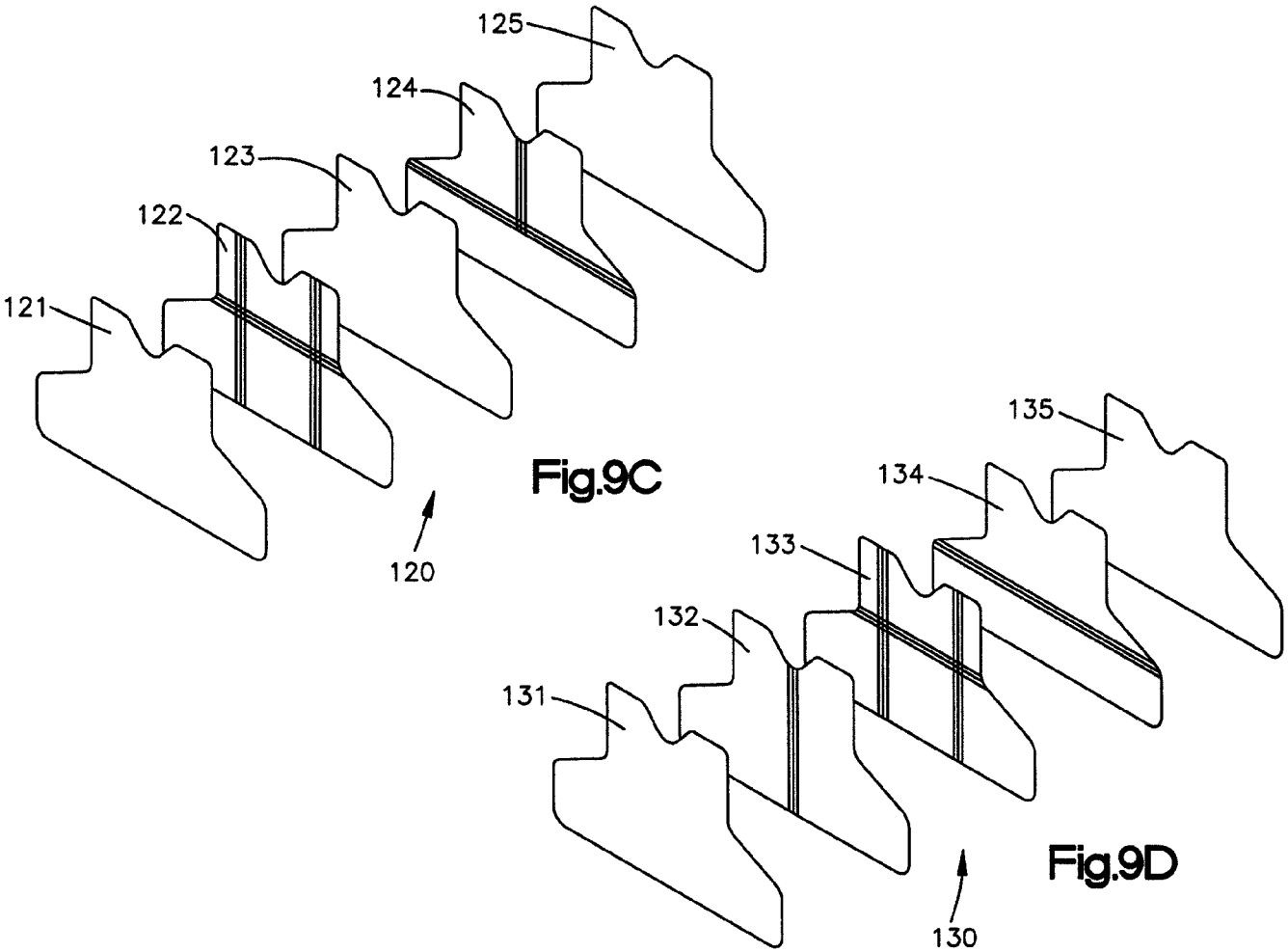

FIG. 9C illustrates portions of a build diagram for building another exemplary vest panel 120 in accordance with the present invention. The vest panel 120 includes five subpacks 121-125. The strike face subpack 121 does not have any overlapping seams. The next inner subpack 122 is formed using an H-Cut overlapping technique. The next inner (middle) subpack 123 does not have any overlapping seams. The next inner subpack 124 is formed using a T-Cut overlapping technique. The body side subpack 125 does not have any overlapping seams.

FIG. 9D illustrates portions of a build diagram for building another exemplary vest panel 130 in accordance with the present invention. The vest panel 130 includes five subpacks 131-135. The strike face subpack 131 does not have any overlapping seams. The next inner subpack 132 is formed using an I-Cut overlapping technique. The next inner (middle) subpack 133 is formed using an H-Cut overlapping technique. The next inner subpack 134 is formed using an L-Cut overlapping technique. The body side subpack 135 does not have any overlapping seams.

Figure 9E:
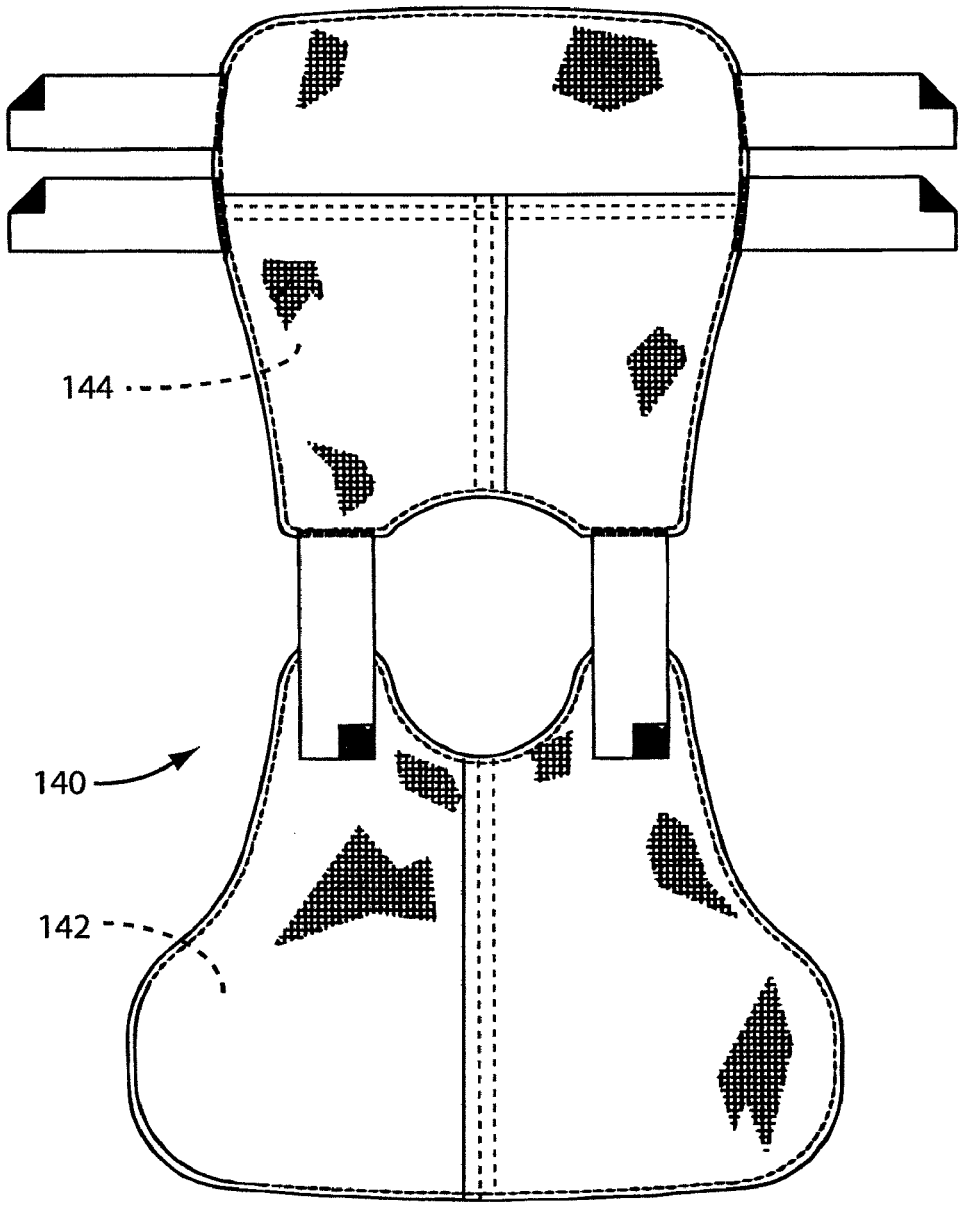
FIG. 9E illustrates a vest including both a front panel and a back panel in accordance with the invention.

FIG. 9E illustrates that a vest 140 can include both a front panel 142 and a back panel 144 in accordance with the invention.

It is preferred (though not required or essential) that the subpack closest to the panel's strike face not be made with the overlapping layers technique. Rather, subpacks made with the overlapping technique are preferably used toward the body side of the panel. This is because the subpacks that are located toward the strike face of the panel, most often use woven aramid fabrics (with or without micro-laminate coatings). The woven aramids incorporate twisted fibers to form yarns that are then woven into a fabric, with micro-laminate resin coating the fabric to keep the yarns from separating and moving off the desired 0 degree/90 degree cross-pattern. The woven aramids are preferred on the strike face because when a bullet hits the panel at a high velocity, it is spinning rapidly from the rifling in the gun barrel, and these fabrics are best at forcing the projectile to begin to "mushroom" or expand, and/or "yaw" or turn on its side, thus stopping the bullet's momentum. The spinning motion is stopped by the intertwined yarns, and the longer the yarn, the better. For this reason, it is preferred not to provide sectioned layers (made with the overlapping technique) toward the strike face, because the bullet would hit aramid yarns that are shorter.

However, subpacks made with the overlapping technique are very useful toward the body side of the panel, because they help to isolate effects of the ballistic event, reinforce areas for improved ballistic performance and reduced backface signature (trauma), and reduce impact movement and increase impact recovery.

The invention claimed is:

1. A ballistic panel for a ballistic garment, the panel having an outline defined by an outer periphery;

the panel including a plurality of subpacks overlying each other and secured to each other to form the panel, each one of the plurality of subpacks having substantially the same outline as the panel;

a first one of the plurality of subpacks including a plurality of layers of ballistic material, each one of the layers in the first subpack having substantially the same outline as the first subpack;

each one of the layers in the first subpack comprising at least first and second layer sections that individually each form only a portion of the outline of the first subpack and that overlap each other along at least one seam to form the layer which thereby has substantially the same outline as the first subpack, with an edge portion of the first layer section overlapping an edge portion of the second layer section;

the panel including at least one stitching section that extends through the edge portions of all of the first and second layer sections in the subpack to form the first subpack;

each one of the layers in the first subpack being discontinuous at the seam; wherein the plurality of subpacks also includes second and third subpacks in addition to the first subpack;

the second subpack includes a plurality of continuous layers of ballistic material each having substantially the same outline as the second subpack and the third subpack includes a plurality of continuous layers of ballistic material each having substantially the same outline as the third subpack;

wherein the second subpack has a different overlapping seam configuration from the first subpack, the third subpack has a different overlapping seam configuration from the first and second subpacks, and the plurality of subpacks includes at least a fourth subpack consisting of layers having substantially the same outline as the fourth subpack and being free of seams therein.

2. A ballistic panel as set forth in claim 1 wherein:

all of the first layer sections of the first subpack overlie each other in a first stack without any second layer sections, and all of the second layer sections of the first subpack overlie each other in a second stack without any first layer sections, and an edge portion of the first stack overlies an edge portion of the second stack, the least one stitching section extending through the edge portion of the first stack and through the edge portion of the second stack to join all the first layer sections to all the second layer sections, to form the first subpack.

3. A ballistic panel as set forth in claim 1 wherein:

the edge portions of the first layer sections of the first subpack are interlaced with the edge portions of the second layer sections of the first subpack; and the at least one stitching section extends through the interlaced edge portions of the first and second layer sections in the subpack, to join all the first layer sections to all the second layer sections, to form the first subpack.

4. A ballistic panel for a ballistic garment, the panel having an outline defined by an outer periphery; the panel including a plurality of subpacks overlying each other and secured to each other to form the panel, each one of the plurality of subpacks having substantially the same outline as the panel;

a first one of the plurality of subpacks including a plurality of layers of ballistic material, each one of the layers in the first subpack having substantially the same outline as the first subpack;

each one of the layers in the first subpack comprising at least first and second layer sections that individually each form only a portion of the outline of the first subpack and that overlap each other along at least one seam to form the layer which thereby has substantially the same outline as the first subpack, with an edge portion of the first layer section overlapping an edge portion of the second layer section;

the panel including at least one stitching section that extends through the edge portions of all of the first and second layer sections in the subpack to form the first subpack;

each one of the layers in the first subpack being discontinuous at the seam; wherein the at least one stitching section that joins the first layer sections to the second layer sections is the only stitching section that joins the first layer sections to each other, and is the only stitching section that joins the second layer sections to each other;

wherein any perimeter stitching on the subpack is not the primary stitching that forms the seams in the subpack;

each seam being formed by one to three parallel sew lines that extend along the length of the seam;

aside from any tacking or perimeter stitching, the stitching section that joins the first layer sections to the second layer sections being the only stitching section that joins the first layer sections to each other and being the only stitching section that joins the second layer sections to each other.

5. A ballistic panel as set forth in claim 1 wherein each layer in the first subpack includes only two layer sections, that overlap and that together form the entire layer, the overlapping layer edge portions forming a reinforced area of the layer that is positioned along a vulnerable area of a wearer's body.

6. A ballistic panel as set forth in claim 1 wherein each layer in the first subpack includes exactly three layer sections, that overlap and that together form the entire layer, the overlapping layer edge portions forming a reinforced area of the layer.

7. A ballistic panel as set forth in claim 1 wherein each layer in the first subpack includes exactly four layer sections, that overlap and that together form the entire layer, the overlapping layer edge portions forming a stiffened area of the layer.

8. A ballistic panel as set forth in claim 1 wherein the at least one seam extends vertically or horizontally across the subpack and does not extend along the perimeter of the subpack.

9. A ballistic panel as set forth in claim 8 wherein the at least one seam is a single seam that extends vertically on the panel in a straight line for the full height of the subpack and that is located to overlie the sternum and/or spinal area of the wearer.

10. A ballistic panel as set forth in claim 8 wherein the at least one seam is a single seam that extends horizontally in a straight line for the full width of the subpack and that is located to overlie the lower rib cage area of the wearer.

11. A ballistic panel as set forth in claim 8 wherein the at least one seam includes a first seam that extends vertically on the panel in a straight line for the full height of the subpack and that is located to overlie the sternum and/or spinal area of the wearer and a second seam that extends horizontally in a straight line for the full width of the subpack and that is located to overlie the lower rib cage area of the wearer.

12. A ballistic panel as set forth in claim 8 wherein the at least one seam includes:

a first seam that extends horizontally in a straight line for the full width of the subpack and that is located to overlie the lower rib cage area of the wearer; and second and third seams that extend vertically in a straight line for the full height of the subpack and that are located on opposite sides of the sternum and/or spinal area of the wearer.

13. A ballistic panel as set forth in claim 1 including five subpacks including a strike face subpack that does not have any overlapping seams, a next inner subpack that is formed using an L-Cut overlapping technique, a next inner (middle) subpack that is formed using an I-Cut overlapping technique, a next inner subpack that does not have any overlapping seams, and a body side subpack that is formed using a T-Cut overlapping technique.

14. A ballistic panel as set forth in claim 1 including five subpacks including a strike face subpack that does not have any overlapping seams, a next inner subpack that is formed using an L-Cut overlapping technique, a next inner (middle) subpack that is formed using an I-Cut overlapping technique, a next inner subpack that is formed using an H-Cut overlapping technique, and a body side subpack that does not have any overlapping seams.

15. A ballistic panel as set forth in claim 1 including five subpacks including a strike face subpack that does not have any overlapping seams, a next inner subpack that is formed using an H-Cut overlapping technique, a next inner (middle) subpack that does not have any overlapping seams, a next inner subpack that is formed using a T-Cut overlapping technique, and a body side subpack that does not have any overlapping seams.

16. A ballistic panel as set forth in claim 1 including five subpacks including a strike face subpack that does not have any overlapping seams, a next inner subpack that is formed using an I-Cut overlapping technique; a next inner (middle) subpack that is formed using an H-Cut overlapping technique; a next inner subpack that is formed using an L-Cut overlapping technique; and a body side subpack that does not have any overlapping seams.

* * * * *